US005796849A

United States Patent [19]

Coleman et al.

[11] Patent Number: 5,796,849

[45] Date of Patent: Aug. 18, 1998

[54] ACTIVE NOISE AND VIBRATION CONTROL SYSTEM ACCOUNTING FOR TIME VARYING PLANT, USING RESIDUAL SIGNAL TO CREATE PROBE SIGNAL

[75] Inventors: Ronald Bruce Coleman, Arlington; Bill Gene Watters, Gloucester; Roy Allen Westerberg, Concord, all of Mass.

[73] Assignee: Bolt, Beranek and Newman Inc., Cambridge, Mass.

[21] Appl. No.: 335,936

[22] Filed: Nov. 8, 1994

[51] Int. Cl.[6] ..... A61F 11/06; H03B 29/00

[52] U.S. Cl. ..... 381/71.8; 381/71.12; 381/71.11

[58] Field of Search ..... 381/71, 94, 71.1, 381/71.2, 71.8, 71.12, 71.13, 94.1, 71.11

[56] References Cited

U.S. PATENT DOCUMENTS

| | | | |
|---|---|---|---|
| 4,122,303 | 10/1978 | Chaplin et al. . | |
| 4,417,098 | 11/1983 | Chaplin et al. . | |
| 4,480,333 | 10/1984 | Ross | 381/71.8 |
| 4,677,676 | 6/1987 | Eriksson . | |
| 4,947,435 | 8/1990 | Taylor | 381/71.11 |
| 5,327,496 | 7/1994 | Russell et al. | 381/94.2 |
| 5,402,496 | 3/1995 | Soli | 381/71 |

FOREIGN PATENT DOCUMENTS

| | | |
|---|---|---|
| 0611089 | 8/1994 | European Pat. Off. . |
| 0615224 | 9/1994 | European Pat. Off. . |

OTHER PUBLICATIONS

C. Bao et al., "Comparison of Two On-Line Identification Algorithms for Active Noise Control", *Recent Advances in Active Control of Sound and Vibration*, Apr. 28–30, 1993, pp. 38–51.

B. Finn et al., "Musical Interference Suppression and On-Line Modeling Techniques for Multi-Channel Active Noise Control Systems", *Recent Advances in Active Control of Sound and Vibration*, Apr. 28–30, 1993, pp. 969–980.

K. Reichard et al., "Frequency-Domain Implementation of the Filtered-X Algorithm with On-Line System Identification", *Recent Advances in Active Control of Sound and Vibration*, Apr. 28–30, 1993, pp. 562–573.

S. J. Elliot et al., "Active Noise Control", *IEEE Signal Processing Magazine*, Oct. 1993, pp. 12–35.

S. J. Elliott et al., "A Multiple Error LMS Algorithm and Its Application to the Active Control of Sound and Vibration", *IEEE Transactions on Acoustics, Speech, and Signal Processing*, vol. ASSP-35, No. 10, Oct. 1987, pp. 1423–1434.

Widrow et al., *Adaptive Signal Processing*, Prentice Hall, Inc., 1985, pp. 288–295.

Lawson et al., "The Pseudoinverse", *Solving Least Squares Problems*, Prentice-Hall, Inc., 1974, pp. 36–40.

Soderstrom et al., "Instrumental Variable Methods", *System Identification*, Prentice Hall, Inc., 1989, pp. 260–277, 327, 328, and 385–388.

Copy of Communication dated Sep. 5, 1997 w/European Search Report re EPO Appln. No. 95307979.5.

*Primary Examiner*—Minsun Oh Harvey

*Attorney, Agent, or Firm*—Henry D. Pahl, Jr.; David D. Lowry; Kevin J. Fournier

[57] ABSTRACT

An active noise and vibration control system is constructed such that the residual signal from the residual sensor is fed back into the controller and used to generate the probe signal. Measurements of the residual signal are used to create a related signal, which has the same magnitude spectrum as the residual signal, but which is phase-uncorrelated with the residual signal. This latter signal is filtered by a shaping filter and attenuated to produce the desired probe signal. The characteristics of the shaping filter and the attenuator are chosen such that when the probe signal is filtered by the plant transfer function, its contribution to the magnitude spectrum of the residual signal is uniformly below the measured magnitude spectrum of the residual by a prescribed amount (for example, 6 dB) over the entire involved frequency range. The probe signal is then used to obtain a current estimate of the plant transfer function.

46 Claims, 8 Drawing Sheets

H
11
20
35
T
14
21
13
W
351
355
16
P
17
19
18
12
e
a
d
n
LMS
352
354
$\hat{P}_{COPY}$
357
$\hat{P}$
358
LMS
359
356
359a
PROBE GENERATION CIRCUIT
353

ACTIVE NOISE AND VIBRATION CONTROL SYSTEM ACCOUNTING FOR TIME VARYING PLANT, USING RESIDUAL SIGNAL TO CREATE PROBE SIGNAL

FIELD OF THE INVENTION

The present invention relates to active control systems for reducing structural vibrations or noise. In particular, the invention relates to control of systems for which the dynamics of the transfer functions between the actuation devices and the residual sensors change with time. For example, if the system to be controlled is the interior noise within an automobile, factors such as passenger location and air temperature will cause these transfer functions to change with time.

BACKGROUND OF THE INVENTION

Active noise and vibration control systems are well known for the purpose of reducing structural vibrations or acoustic noise. For example, FIG. 1 shows such a well known system with respect to acoustic noise operating under the traditional "filtered-x LMS algorithm" developed by Widrow et al (*Adaptive Signal Processing*, Englewood Cliffs, N.J., Prentice-Hall, Inc., 1985).

As shown in FIG. 1, a disturbance d which can be either sound or vibration, induces a response at a first measurement location on line 20, which is measured by the residual sensor 12. 11 is the physical transfer function H between the disturbance and the residual sensor 12. The disturbance d also induces a response at a second measurement location on line 21, which is measured by a reference sensor 13. 14 is the physical transfer function T between the disturbance and the reference sensor 13.

The electrical signal output from the reference sensor 13 is input to controller 15. The purpose of controller 15 is to create a compensating electrical signal which, when used as an input to an actuation device 16, will produce a response at the residual sensor which is equal in magnitude but opposite in phase to the residual sensor response (20) induced by the disturbance d. Thus, when the residual sensor response produced by the controller 19 is added (see adder 18 in the FIG. 1 model) to the residual sensor response caused by the disturbance 20, the goal is that these two responses will cancel creating less vibration or acoustic noise at the residual sensor location. 17 is the physical transfer function P (hereafter referred to as "the plant") between the actuation device 16 and the residual sensor 12.

The electrical signal output from reference sensor 13 is input along line 155 to the controller 15. Controller 15 is made up of a variable control filter 151, whose transfer function characteristics W change based on the output 156 of a Least Mean Square (LMS) circuit 152. The LMS circuit 152 receives an input 153 from the electrical signal output from residual sensor 12. The signal on line 155 is also input to a filter circuit $\hat{P}$ 154 whose transfer function is an approximation of the transfer function P of the plant 17. The output 157 of filter 154 is fed as a second input to LMS circuit 152. Using inputs 157 and 153, the LMS circuit continuously adapts the characteristics of the variable control filter 151 in order to create a control signal 158 at the output of filter 151 which will drive an actuation device 16 to create a residual sensor response equal in magnitude but opposite in phase to that caused by the disturbance d existing on line 20. Ideally, the control filter converges to -H/PT.

The residual sensor 12 also picks up auxiliary noise a from auxiliary noise sources (e.g., sensor noise and/or response to secondary disturbances). These are shown in FIG. 1 as inputs to model adder 18.

This prior art system, however, assumes that the plant transfer function P remains nearly constant with time so that $\hat{P}$ is fixed yet provides a good match to P despite these changes. If however, the characteristics of the filter $\hat{P}$ 154 are maintained constant despite more significant changes which may occur in the physical transfer function P ("the plant") between actuation device 16 and reference sensor 12, this can lead to degraded performance and/or instability in the operation of the controller 15. In order to maximize controller performance, accurate estimates of the plant are required to update filter circuit $\hat{P}$ 154.

Another prior art system (U.S. Pat. No. 4,677,676 Jun. 30, 1987 to Eriksson), as shown in FIG. 2, attempted to solve the problem of more significant variations of the plant. Only the components differing from the FIG. 1 system will be explained. Eriksson used a different controller 25 which includes an electrical addition circuit 255 located after the variable control filter 251. The addition circuit 255 also receives an input from an externally generated probe signal n along line 256. The probe signal n is also input to an additional LMS circuit 258 and to a variable filter 257, whose characteristics are changed by the output from EMS circuit 258. The output of filter 257 is fed into an inverted input of another electrical addition circuit 259. Addition circuit 259 also receives an input from the residual sensor 12, and provides an output to LMS circuit 258.

In Eriksson's system, the probe signal n is a low level random noise signal. By injecting such a probe signal into the control loop, on-line identification/adaptation of the plant filter 257 is approximated. The characteristics of filter 257 are periodically copied to variable filter 254 (which takes the place of fixed characteristic filter 154 of FIG. 1).

Eriksson's system allows the control filter 251 to have its transfer function characteristic W converge to -H/PT during closed loop operation in the presence of a time varying plant transfer function. The weights of filter 257 are adapted to approximate the plant transfer function P over the required bandwidth. Assuming n is uncorrelated with d and a, the weights of filter 257 provide an unbiased estimate of the plant transfer function P.

Although time varying plants can be handled, the prior art Eriksson system of FIG. 2 has the following drawbacks.

First, the magnitude of the probe signal is held constant. Therefore, as the magnitude of the disturbance increases relative to the probe as a function of frequency, the effective convergence rate for the plant filter will decrease. Alternatively, as the disturbance decreases relative to the probe as a function of frequency, the convergence rate will increase, but may result in causing significant noise amplification.

Secondly, the spectral shape of the probe signal (commonly chosen as flat—i.e., "white noise") is independent of the spectral shape of the residual signal and plant transfer function. Consequently, the signal to noise ratio as a function of frequency for the plant estimation, the noise amplification as a function of frequency, and the mismatch between the plant transfer function P and the plant estimate $\hat{P}$ as a function of frequency will be non-uniform across frequency. This can result in temporary losses of system performance for control of slewing tonals and non-uniform broadband control.

SUMMARY OF THE INVENTION

It is an object of the present invention to achieve an active noise and vibration control system which takes into account the fact that the plant transfer function varies with time, in which the magnitude as a function of frequency of the probe signal used to estimate the plant is not held constant over time. This will maintain the convergence rate of the control filter without increasing the noise amplification in the presence of changes in the magnitude spectrum of the disturbance.

It is a further object of the invention to achieve an active noise and vibration control system which takes into account the fact that the plant transfer function varies with time, in which the spectral shape of the probe signal used to estimate the plant is dependent on the spectral shape of the residual signal and plant transfer function. This will minimize temporary losses of system performance for control of slewing tonals and non-uniform broadband control, which were present in the prior art as described above.

The present invention attains these advantages, among others, by constructing an active noise and vibration control system such that the residual signal from the residual sensor is fed back into the controller and used to generate the probe signal. Measurements of the residual signal are used to create a related signal, which has the same magnitude spectrum as the residual signal, but which is phase-uncorrelated with the residual signal. This latter signal is filtered by a shaping filter and attenuated to produce the desired probe signal. The characteristics of the shaping filter and the attenuator are chosen such that when the probe signal is filtered by the plant transfer function, its contribution to the magnitude spectrum of the residual signal is uniformly below the measured magnitude spectrum of the residual by a prescribed amount (for example, 6 dB) over the entire involved frequency range. The probe signal is then used to obtain a current estimate of the plant transfer function.

BRIEF DESCRIPTION OF THE PREFERRED EMBODIMENTS

DETAILED DESCRIPTION OF THE PREFERRED EMBODIMENTS

Figure 1:
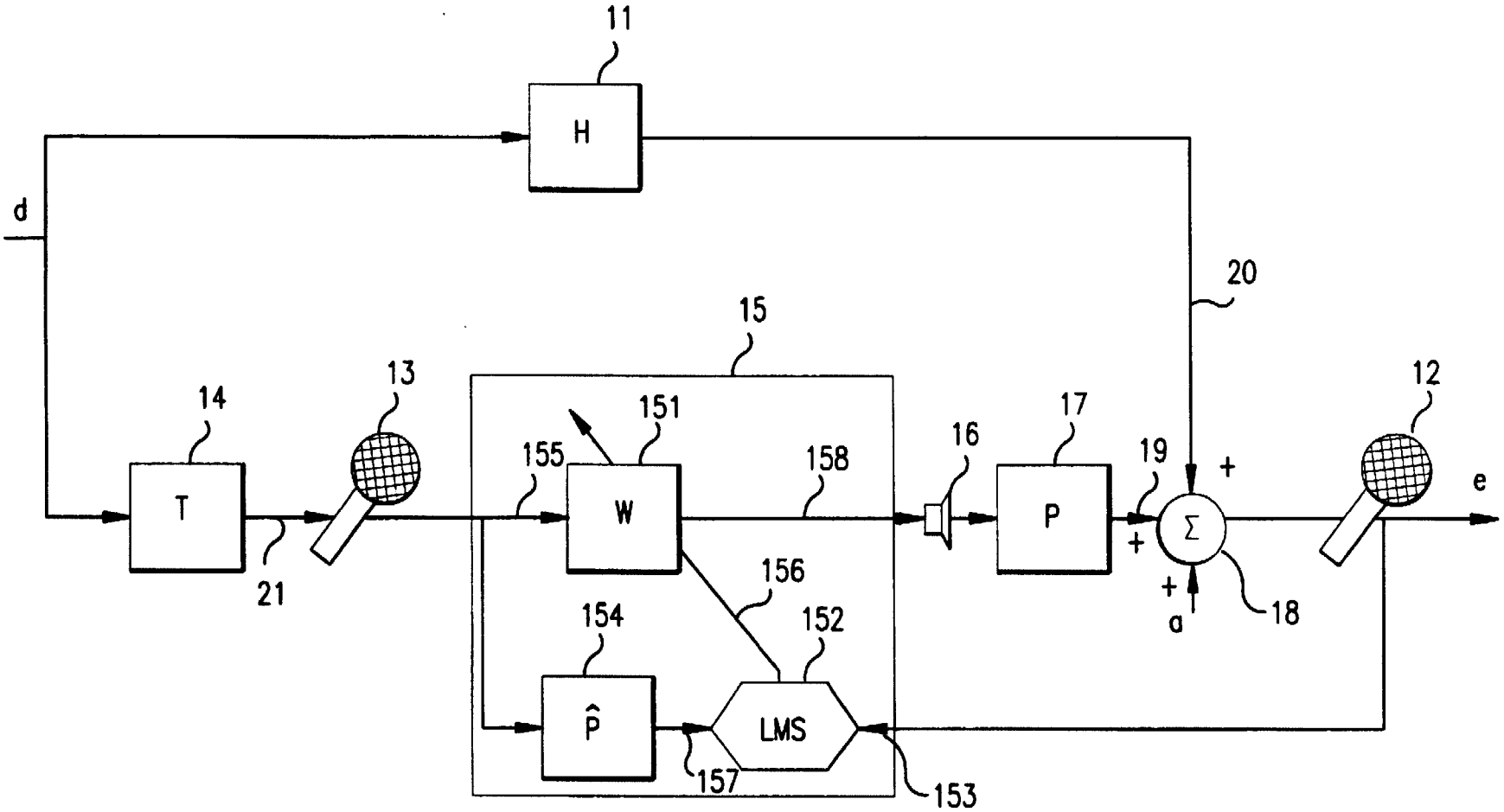
FIG. 1 PRIOR ART
FIG. 1 shows a prior art system which assumes that the plant transfer function is nearly constant with time.
Figure 2:
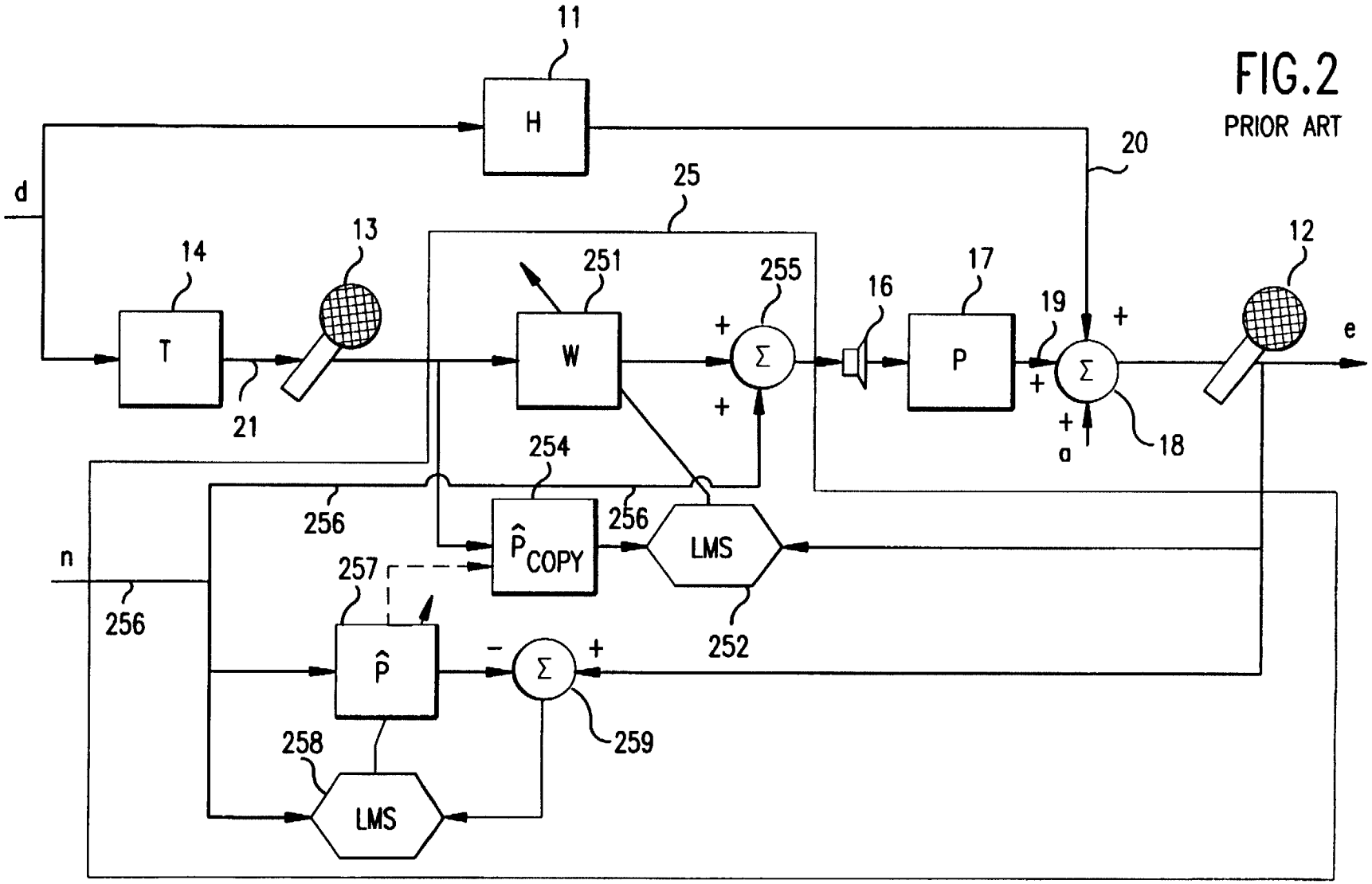
FIG.2 PRIOR ART
FIG. 2 shows another prior art system which takes into account a time varying plant transfer function, but uses a constant magnitude white noise probe signal.
Figure 3:
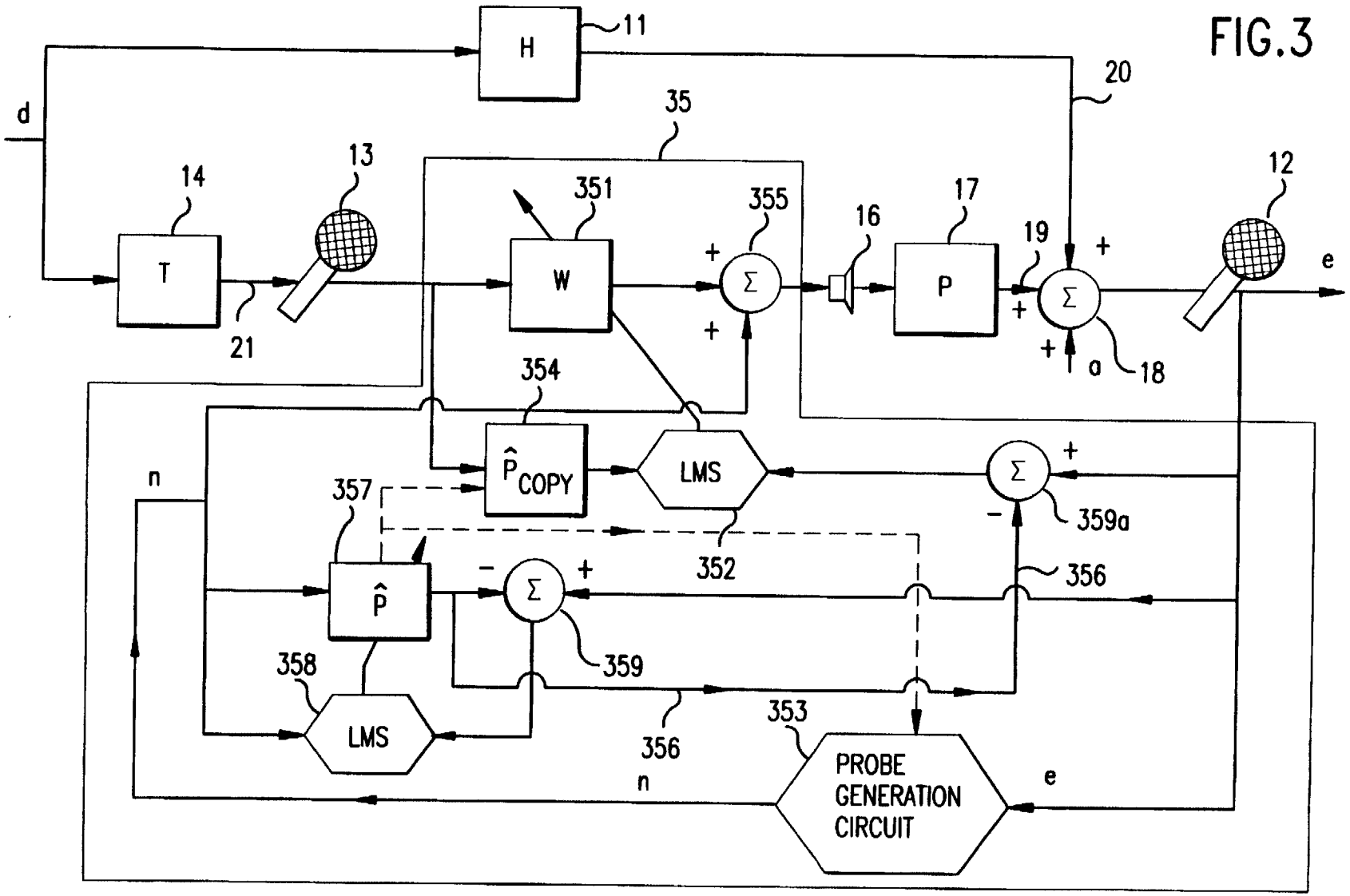
FIG. 3 shows a feedforward system according to the present invention.

The general layout of the active noise and vibration control system according to the present invention is shown in FIG. 3. Again, only system elements differing from the basic structure of FIGS. 1 and 2 will be explained.

Like FIG. 2, the system of Fig. 3 injects a probe signal n into the output of the control filter 351 by means of an addition circuit 355. However, the origin of the probe signal n is quite different. The output of residual sensor 12 is fed back into the controller 35 and into a probe generation circuit 353, whose details will be explained below. The probe generation circuit also receives as input the weights of filter circuit 357 which corresponds to the filter 257 of FIG. 2, so that the transfer function characteristics of filter 357 can be transferred to the probe generation circuit 353. The output of probe generation circuit 353 is probe signal n, which is fed to filter 357, LMS circuit 358, and addition circuit 355.

Another modification of the FIG. 2 system is that the output of the residual sensor is fed into another electrical addition circuit **359*a*, which receives as input the output of residual sensor 12, and also receives, through an inverted input, the output of filter 357 along line 356. The output of addition circuit 359*a* is then fed as an input to LMS circuit 352**.

FIG. 3 presents an approach for deriving the probe signal n from on-line measurements of the residual signal e. According to the invention, the spectral shape of the probe signal is optimized to result in nominally a constant signal-to-noise ratio (SNR) for the purpose of adapting the plant filter $\hat{P}$ 357 throughout the frequency range of concern. In addition, this SNR is maximized consistent with limiting noise amplification to a specified level. Finally, since injection of the probe signal n will degrade the effective convergence rate for the control filter, a procedure for minimizing this degradation is included. The theory embodied in Applicant's embodiments adapted to attain the above goals will now be derived.

The power spectrum $S_{ee}$ of the residual signal e from FIG. 3 in the absence of the probe signal n (i.e., n=0) is given by:

$$S_{ee}\left({}^{w}/_{o}\right)=|H+TWP|^2S_{dd}+S_{aa} \tag{1}$$

where $S_{ee}$=power spectrum of the residual sensor response e $S_{dd}$=power spectrum of disturbance d $S_{ea}$=power spectrum of the auxiliary noise signal a.

When the probe n is non-zero, the power spectrum of the residual becomes:

$$S_{ee}(w)=|H+TWP|^2S_{dd}+|P|^2S_{nn}+S_{aa} \tag{2}$$

Noise amplification is defined as the ratio of the power spectrum of the residual with the probe $S_{ee}(w)$ to the power spectrum of the residual without the probe $S_{ee}\left({}^{w}/_{o}\right)$. This ratio is thus a measure of the impact of injecting the probe. For example, suppose that the plant filter were initially determined very accurately (e.g. off-line) so that a system noise reduction of 40 dB was obtained. If the probe circuit of FIG. 3 with noise amplification of 2 dB were then added, the system noise reduction would be reduced to 38 dB. This small reduction is the price paid for enabling the system to maintain essentially the same noise reduction in spite of plant variations which might otherwise cause much larger noise reduction degradations, or even cause it to become unstable. Constraining this ratio to be less than a prescribed noise amplification limit throughout the controller bandwidth results in the following inequality:

$$\frac{S_{ee}(w)}{S_{ee}(w/o)} \leqq 10^{(NA/10)}. \tag{3}$$

where NA=acceptable noise amplification level (db).

Applicant's approach is to define the power spectrum of the probe in terms of the power spectrum of the residual as defined in Eq. 2. This is a judicious choice because it results in a probe signal strength that tracks changes in the disturbance level. In addition, this choice results in a relatively simple expression relating the spectral shape of the probe power spectrum to the residual. As a consequence, the probe signal power spectrum is defined as $$S_{nn}=|B|^2 S_{ee}(w), \tag{4}$$

where B is a frequency-dependent shaping function to be determined. With this definition for $S_{nn}$, the closed loop residual becomes $$S_{ee}(w)=\frac{|H+TWP|^2 S_{dd}+S_{aa}}{1-|PB|^2} \tag{5}$$

The frequency dependent shaping function B is determined by substituting Eqs. 1 and 5 into Eq. 3 and solving for B which satisfies the equality. The solution for B is given in Eq. 6:

$$B=\beta P^{-1} \tag{6}$$

where $$\beta=\sqrt{\frac{10^{(NA/10)}-1}{10^{(NA/10)}}}\ . \tag{7}$$

For this choice of B, $$\frac{S_{ee}(w)}{S_{ee}(w/o)} = \frac{1}{1-\beta^2} = 10^{(NA/10)} \tag{8}$$

From Eq. 8, the impact of the probe-signal injection is limited to increasing the residual uniformly across frequency by the allowed NA value. The SNR (of the probe signal contribution in the residual signal e) for estimating the plant using this choice for $S_{nn}$ (Eqn. 4) can be shown to be constant across frequency and is given by:

$$SNR=\frac{|\beta|^2}{1-|\beta|^2}\ . \tag{9}$$

As an example, for NA=2 dB, $$\beta \approx 0.607 \qquad SNR \approx 0.584(\text{approx. } -6\text{dB}) \tag{10}$$

The effective convergence rate for the control filter 351 (W) can be optimized by adapting W based on an estimate of the residual signal in the absence of injecting the probe. This is shown in FIG. 3 by the inclusion of the addition circuit 359*a* which receives the residual e at one input and receives the output of filter 357 at an inverted input, and whose output goes to the LMS circuit 352 which acts to adapt the coefficients of filter 351 to thus change the transfer function thereof.

Equation 8 shows also that this feedback probe-generation approach is potentially unstable in a power sense, that is, the noise amplification is related to $\beta^2$. This is expected since the probe signal n is based on the power spectrum of the residual e, which carries no phase information. The potential instability of this path is not a problem, however, since $\beta$ is a design parameter chosen in accordance with Eq. 7, thereby limiting noise amplification to a prescribed level.

Thus, the strength of the probe signals and the spectral shape thereof are chosen such that the impact of injecting the probe signals into the loop is limited to increasing the power spectrum of the residual sensor by a prescribed amount throughout the frequency range over which the plant is to be estimated, in the presence of variations in the plant, or changes in the disturbance level.

Next, a procedure is presented for generating a probe signal that satisfies the desired relationship between the power spectra of the probe and that of the residual signal, such a probe signal being uncorrelated with the disturbance and auxiliary noise signals.

From the development presented above, the power spectrum of the probe signal to be generated is given by Eq. 11.

$$S_{nn}=\frac{\beta^2}{|P|^2}\ S_{ee}(w) \tag{11}$$

Figure 4:
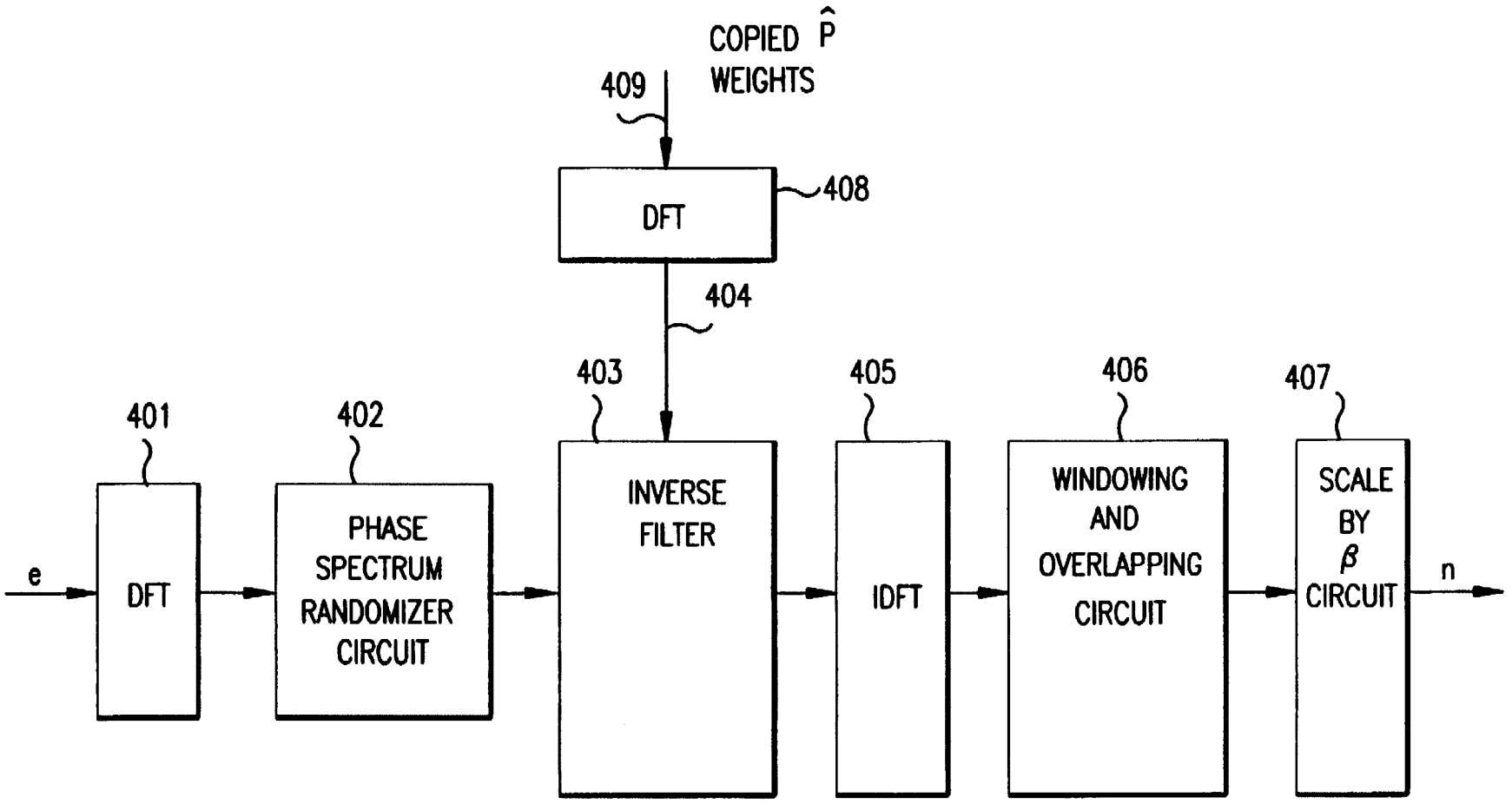
FIG. 4 shows a frequency domain embodiment of the probe signal generation circuit of the present invention.

One procedure for generating a probe signal n that satisfies Eq. 11 and is uncorrelated with the disturbance d and noise a is shown in the block diagram of FIG. 4.

FIG. 4 shows a preferred frequency-domain embodiment of the probe generation circuit 353 of FIG. 3. As shown in FIG. 4, the residual signal e output from the residual sensor 12 of FIG. 3 is input to a DFT circuit 401 which takes the Discrete Fourier Transform of the time domain residual signal e thus translating it into the frequency domain.

Once in the frequency domain, the phase component of the residual is randomized by phase spectrum randomizer circuit 402. For example, the output of a random number generator is used to replace the phase values of the residual. In so-randomizing the phase, it is ensured, however, that the DC and Nyquist indexes (bins) of the DFT result are purely real. Also, it is ensured that the phase values above Nyquist are opposite in sign to their mirror images below Nyquist. Therefore, the resulting magnitude and phase spectrums are conjugate symmetric.

Then, the randomizer circuit output is shaped in the frequency domain using inverse filter 403. The inverse filter corresponds to the inverse of the plant transfer function as shown in the expression for the shaping function given in Equation 6. That is, the spectrum of the residual (once decorrelated with the disturbance and auxiliary noise via the phase scrambling of phase spectrum randomizer circuit 402) is filtered in the frequency domain by an estimate of the inverse of the plant.

An estimate of the frequency response of the plant is obtained by copying the weights of the plant filter estimate from plant filter $\hat{P}$ 357 into the probe generation circuit 353, where they appear on line 409 of FIG. 4. The copied weights are then transformed into the frequency domain by taking the DFT of the weights using DFT circuit 408. The size of the DFT's in circuits 408 and 401 must be the same. The frequency transformed weights, which correspond to an estimate of the frequency response of the plant, are then input to inverse filter 403, where the inverse of the frequency response of the plant is taken, frequency-by-frequency, at those frequencies resulting from DFT circuit 408. The output of phase spectrum randomizing circuit 402 is filtered in the frequency domain using inverse filter 403 by multiplying the complex spectrum output from 402 by the frequency response of the inverse filter 403 at each frequency resulting from DFT circuits 401 and 408.

The output of inverse filter 403 is fed into Inverse Discrete Fourier Transform (IDFT) circuit 405, where the signal is transformed back into a real-valued time domain signal. Next, windowing and overlapping functions take place by means of windowing and overlapping circuit 406 in order to remove possible discontinuities between successive time records of the time domain transformed signal. Such windowing and overlapping operations operate under the same principle as those which are known for use in signal processing for Discrete Fourier Transform analysis of a time series. For example, a Hanning window with 50% overlapping may be used for this purpose.

The time series data are then scaled by the gain term β discussed above in Eq. 6, by means of the scale by β circuit 407. The resultant probe signal n is then injected into the control loop of FIG. 3 from the output of probe generation circuit 353.

This procedure for probe signal generation results in a closed loop feedback path. It is potentially unstable in a power sense, as shown in Eq. 8. As a consequence, the scaling factor β must be limited to avoid excessive noise amplification. Because this closed-loop path is potentially unstable only in a power sense, however, filtering performed in this path need not be causal. That is, filters can be applied directly to the magnitude response of the residual power spectrum. For example, median smoothers in frequency can be used to advantage in order to remove tonal components in the residual. As a specific example, a median smoother can be placed in parallel with the phase spectrum randomizer circuit 402 of FIG. 4.

The use of instantaneous DFTs to characterize the power spectrum of the residual is beneficial because it allows the probe signal strength to adjust for relatively rapid changes in the magnitude spectrum of the disturbance as a function of time. The magnitude spectrum of the probe signal is determined from the magnitude response during the previous time record for the DFT. Since these time records are typically on the order of a few seconds (to resolve the spectral features of the plant transfer function), the time delay between changes in disturbance level and a change in probe strength is kept small.

Further, the use of DFT processing to generate the probe signal results in a difference equation relating the power spectra of the residual with and without the probe.

$$S_{ee(w)}(k)=S_{ee(w/o)}(k)+\beta^2 S_{ee(w)}(k-1), \tag{12}$$

where k is the index of the current DFT time record.

Therefore, an equivalent expression for Eq. 8 becomes $$\frac{S_{ee(w)}(k)}{S_{ee(w/o)}(k)} = \sum_{i=0}^{k} \beta^{2i} \frac{S_{ee(w/o)}(k-i)}{S_{ee(w/o)}(k)} \tag{13}$$

In this expression, the term $\beta^{2i}$ can be viewed as a "forgetting factor." To the extent that the residual power spectrum is "nominally" stationary (i.e., is nearly constant over time records for which $\beta^{2i}$ is significant), the summation in Eq. 13 approaches $$\frac{1}{1-\beta^2},$$

which agrees with Eq. 8.

Further, if it is known in advance that the disturbance, d, is bandlimited within a specific bandwidth, e.g., if d is a steady tone, then the plant need only be estimated over a limited frequency range. Therefore, a band limiting filter can be inserted after the phase spectrum randomizer circuit 402. This reduces computation requirements in certain applications.

Derivation for MIMO Control:

The derivation of the probe-generation approach for multiple-input-multiple-output (MIMO) control systems follows from the single-input-single-output (SISO) approach detailed above. In general, extending SISO concepts to analogous MIMO concepts is well known. See Elliott et al., "A Multiple Error LMS Algorithm and its Application to the Active Control of Sound and Vibration", IEEE Transactions on Acoustics, Speech, and Signal Processing, Vol. ASSP-35, No. 10, p. 1423–1434, October 1987; and Elliot et al., "Active Noise Control", IEEE Signal Processing Magazine, October 1993, p. 12–35. In particular, the vectors of residual power spectra in the absence of the probe signal and with the probe signal are defined in Equations 14 and 15, respectively.

$$\vec{S}_{ee}(^{w}/_{o})=|H+TWP|^2\vec{S}_{dd}+\vec{S}_{aa} \tag{15}$$

$$\vec{S}_{ee}(w)=[I-|PB|^2]^{-1}\{|H+TWP|^2\vec{S}_{dd}+\vec{S}_{aa}\} \tag{15}$$

where $\vec{S}_{ee}$==power spectrum of the residual sensor vector $\vec{e}$ $\vec{S}_{dd}$==power spectrum of disturbance vector $\vec{d}$ $\vec{S}_{aa}$==power spectrum of the auxiliary noise vector $\vec{a}$, and I==S×S identity matrix S==number of residual sensors $|x|^2$==matrix whose elements are the squared magnitudes of the elements of matrix X.

The expressions in Equations 14 and 15 have assumed that the elements of the disturbance vector and the auxiliary noise vector are statistically independent. An equivalent expression could be written for the case where the elements of each of these vectors are not statistically independent. In addition, the result of Equation 15 is obtained by defining the vector of probe signal power spectra in terms of the vector of residual signal power spectra in a similar manner as for the SISO case described above. The equivalent expression to Equation 4 for the MIMO case is given in Equation 16.

$$\vec{S}_{nn}=|B|^2\vec{S}_{e'e'}(w), \tag{16}$$

where $$\vec{S}_{e'e'}(w)=\vec{S}_{ee}(w). \tag{17}$$

For the MIMO case, however, a new signal vector $\vec{e}'$ has been explicitly defined which is related to the residual vector $\vec{e}$. Specifically, the individual elements of the signal vector $\vec{e}'$, while satisfying the power spectrum relationship of Equation 17, are chosen to be statistically independent of each other and uncorrelated with the elements of the residual signal vector $\vec{e}$. That is, the elements of the vector of power spectra $\vec{S}_{e'e'}(w)$ are equal to the power spectra of the corresponding elements in $\vec{S}_{ee}(w)$ (see Equation 17), but the elements of the signal vector $\vec{e}'$ are chosen to be statistically independent and uncorrelated with the disturbance and auxiliary noise vectors. This latter requirement, which can be achieved via a phase spectrum randomizer circuit similar to the circuit 402 shown in FIG. 4, ensures an unbiased estimate of the plant transfer function matrix.

The equivalent constraint of Equation 3 (using the equality) for MIMO control is given in Equation 18.

$$\vec{S}_{ee}(w)=10^{(NA/10)}\vec{S}_{ee}(^{w}/_{o}) \tag{18}$$

It follows from Equations 14, 15 and 18 that for MIMO applications, the solution for the shaping matrix B becomes, $$B=\beta P^{+}, \quad (19)$$

where β is a constant defined previously in Equation 7, and where $P^{+}$ is the matrix inverse of the transfer function matrix (taken frequency by frequency) between the actuation devices and the residual sensors if P is a square matrix. For non-square plant matrices, $P^{+}$ is the pseudo inverse of this transfer function matrix taken frequency by frequency. For a discussion of the pseudo inverse, see Lawson et al. *Solving Least Squares Problems*, Prentice-Hall, Inc., 1974, p. 36–40.

Extension of Approach to Feedback Control:

Applicant's approach presented above for feedforward control systems is applicable for feedback control systems as well. For example, for MIMO, the shaping function matrix B is again equal to a constant β times the inverse (or pseudo-inverse for non-square plants) of the transfer function matrix between input signals to the actuation devices and the responses of the residual sensors, which is the closed-loop plant transfer function matrix. For the feedforward systems of FIGS. 1–3, this transfer function matrix is the plant matrix P. For feedback systems, the inverse to be taken is of the transfer function matrix between the inputs to the actuation devices and the responses of the residual sensors during closed-loop operation. As an example, for a controller whose transfer function characteristics are described by matrix C, the expression for the shaping function matrix B becomes, $$B=\beta\{[I+PC]^{-1}PC\}^{+} \quad (20)$$

Equation 20 assumes that the probe signal vector is injected at the input of the control filter matrix C. Equivalent expressions can be written for the case where the probe is injected at the output of the control filters, or for the case where other filters are included in the feedback loop.

Figure 8:
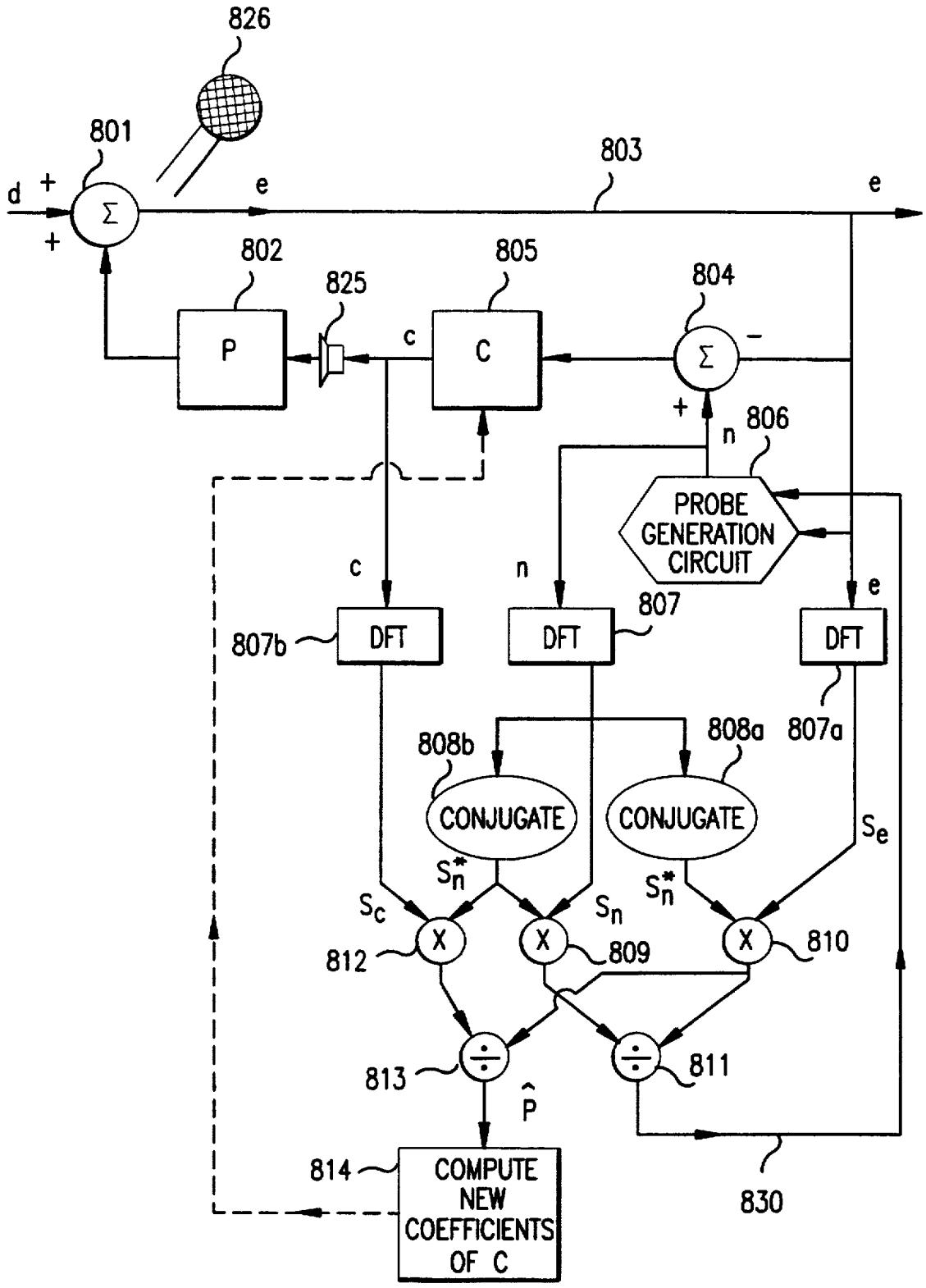
FIG. 8 shows a frequency domain feedback system according to the present invention.

FIG. 8 shows a block diagram of a feedback embodiment of the invention using SISO (single-input-single-output), as an example of the general feedback principles discussed above. Here, the shaping function B is again equal to a constant β times the inverse of the transfer function between the input to the actuation devices and the response of the residual sensors during closed-loop operation. For example, for a controller whose transfer function characteristics are described by the transfer function C, the expression for the shaping function B becomes, $$B=\beta(PC/1+PC)^{-1} \quad (21)$$

In FIG. 8, the disturbance d is input to adder 801 as a first input and the output of the plant 802 is input as a second input to adder 801. The output of adder 801 is the residual signal e on line 803, which is measured by residual sensor 826.

The residual 803 is input through an inverted input to a second adder 804 which also receives an input from the probe signal n. The output of adder 804 is sent as an input to control filter C 805 whose output c is sent to an actuation device 825.

The residual 803 is also provided as an input to probe generation circuit 806, which can have the structure shown in FIG. 4, for example. The probe signal n is generated at the output of probe generation circuit 806. The probe signal n is also sent to a DFT circuit 807 whose output is provided to a conjugate circuit 808*a* and another conjugate circuit 808*b*.

The output of DFT circuit 807 is provided as an input to first multiplier 809. The output of conjugate circuit 808*a* is also provided as a second input to first multiplier 809. The output of conjugate circuit 808*a* is also provided as a first input to a second multiplier 810.

The residual signal e is provided as an input to DFT circuit 807*a*, whose output is provided as a second input to second multiplier 810. A divider 811 receives a divisor input from the output of first multiplier 809 and a dividend input from the output of second multiplier 810. The output of divider 811 is an estimate of the quantity (PC)/(1+PC). As shown by line 830 at the output of divider 811, the estimated frequency response is transferred into the probe generation circuit 806, equivalent to line 404 of FIG. 4.

In FIG. 8, standard signal processing techniques are also used, but not illustrated to preserve clarity. That is, standard windowing and overlapping occurs before the inputs to the DFT's and ensemble averaging of the multiplier outputs takes place before the multiplier outputs are sent to the dividers.

The output of DFT circuit 807 is provided to conjugate circuit 808*b*, whose output is then provided as a first input to third multiplier circuit 812. Third multiplier circuit 812 receives a second input from the output of DFT circuit 807*b* which receives an input from the output of control filter 805. The output of third multiplier circuit 812 is provided as a divisor input to second divider circuit 813, which receives a dividend input from the output of second multiplier circuit 810.

The output of second divider circuit 813 is an estimate of the frequency response of the plant P. This estimate is provided to circuit 814 which generates the weights for control filter 805 therefrom. Techniques for this conversion are well known to those of ordinary skill in the art. See Athans et al., *Optimal Control—An Introduction to the Theory and Its Applications*, McGraw-ESG Hill, Book Company, 1966; Maciejowski, *Multi Variable Feedback Design*, Addison-Wesley Publishing Company, 1989; Åström et al., *Adaptive Control*, Addison-Wesley Publishing Company, 1989.

The above feedback SISO system has been described with respect to a frequency domain implementation. It can be appreciated that the feedback technique can also be implemented in the time domain, using LMS algorithms, to achieve the same results according to the general principles described above.

A purely time domain embodiment of the probe generation circuit 353 of FIG. 3 will now be described, in association with FIG. 6.

In this embodiment, the residual e is passed through a bulk time delay circuit 601 which delays a portion of the residual for a predetermined short time delay. The purpose of this bulk delay is to delay the input by a sufficient amount so that the output signal is uncorrelated with the input signal. The size of the time delay is chosen so as to be longer than estimates of the impulse response of the plant. Since the delay of the delay circuit 601 is short, the amplitude at the output is substantially the same. That is, the residual has not had enough time to change substantially during the short time delay, yet sufficient time has elapsed (relative to the impulse response of the plant), to decorrelate the output of delay 601 with its inputs at all but tonal disturbance frequencies. Therefore, in the absence of tonals in the disturbance, the resultant output signal is phase-uncorrelated with the residual e.

Figure 6:
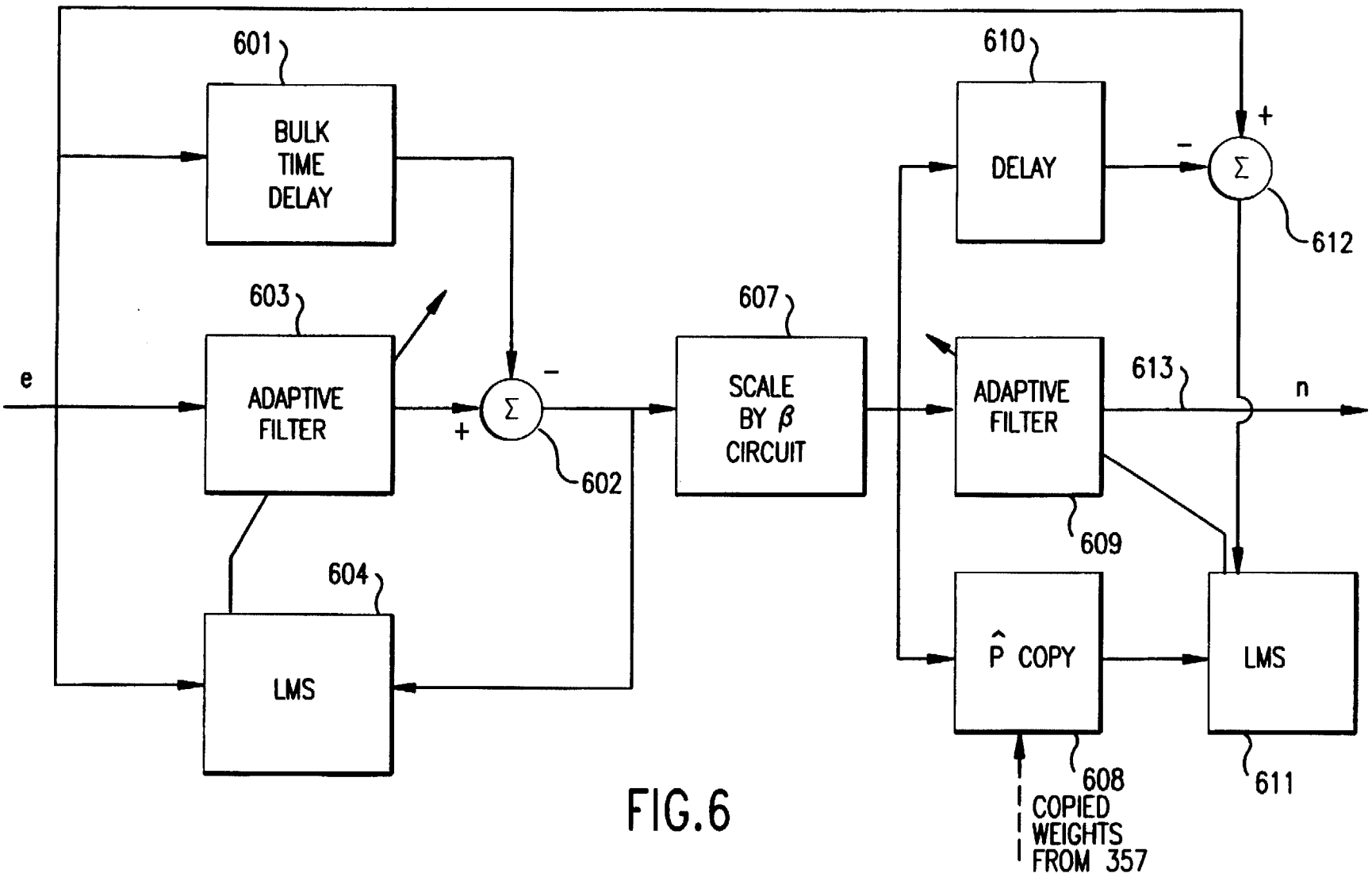
FIG. 6 shows a complete time domain embodiment of the probe signal generation circuit of the present invention.

As further shown in FIG. 6, the output of the delay circuit 601 is an inverted input to adder 602. The residual e is also input to an adaptive filter 603 whose output is presented as another input to the adder 602. The adaptive filter 603 has its weights adapted by means of an LMS circuit 604, which receives inputs from both the residual e and from the output of the adder 602. By providing such additional circuitry, tonal contributions in the residual e can be removed.

The output of adder 602 is then input to a Scale by β circuit 607 which scales the adder 602 output by the value β. The circuit 607's output is then input to adaptive filter 609, delay circuit 610 and plant estimate copy ($\hat{P}$ copy) filter 608. Filter 608 periodically receives copied weights from filter 357 of FIG. 3. The output of filter 608 is input to LMS circuit 611.

The output of delay 610 is fed to an inverted input of adder 612 while the residual signal, e, is applied to a non-inverting input to adder 612. The output of adder 612 is applied as a second input to LMS circuit 611. The LMS circuit controls the transfer function characteristics of the adaptive filter 609 so as to generate the probe signal, n, at output line 613.

The function of delay 610 is to delay the output of the scale by β circuit 607 for a time approximately equal to the time it takes for this output to pass through the various adaptive filters, so as to account for the transit time through such filters, as is generally well known in the art. See Widrow et al cited above. Such a delay period is typically much shorter than that of bulk delay 601.

Accordingly, the circuits 607–612 perform the shaping function of Eqn. 6 by multiplying the output of adder 602 by scale factor β and filtering the resultant signal by an estimate of the inverse of the plant.

Figure 7:
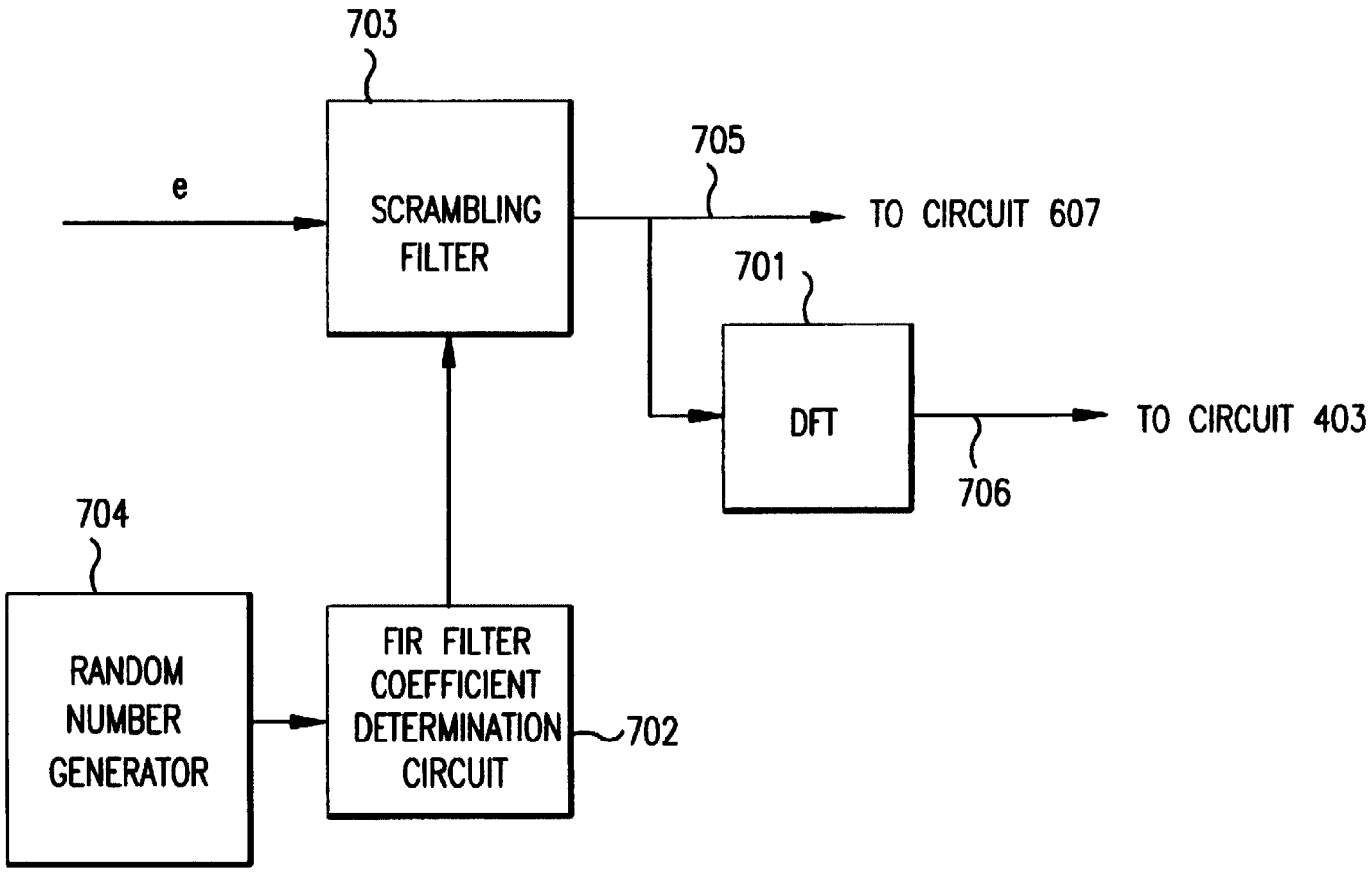
FIG. 7 shows a third embodiment of a portion of the time domain probe signal generation circuit of the present invention.

Two variations on the probe generation circuit embodiments of FIGS. 4 and 6 will now be given with reference to third and fourth embodiments of FIGS. 5 and 7. The embodiments in FIGS. 5 and 7 provide alternate approaches to perform the functionality of circuit elements 401 and 402 in FIG. 4, or to perform the functionality of circuit element 601 in FIG. 6.

Figure 5:
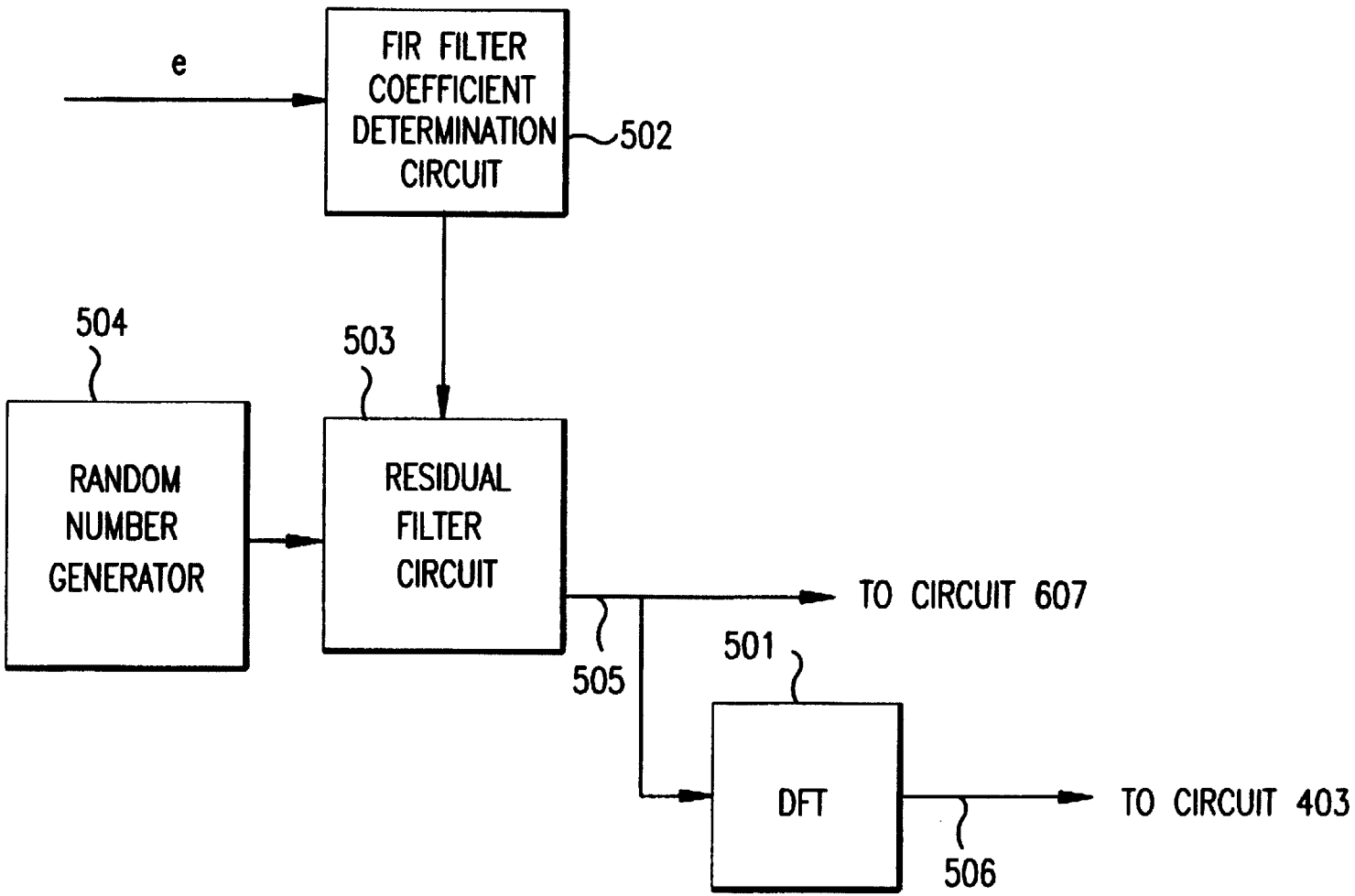
FIG. 5 shows a portion of a time domain probe signal generation circuit of the present invention.

In embodiment three of FIG. 5, the residual signal e is input to a finite impulse response (FIR) filter coefficient determination circuit 502, which functions to select successive time records of the residual signal e for use as FIR filter coefficients by residual filter circuit 503. The output of FIR filter determination circuit 502 is provided as a control input to residual filter circuit 503. The length of the time records by circuit 502 should be chosen long enough to resolve the spectral features of the plant. This time record length, together with the sample rate of the controller, dictate the number of coefficients to be used in residual filter 503.

The output of a random number generator 504 is provided as a data input to residual filter 503. The amplitude of the random noise from the random number generator 504 is chosen so that the average power spectral density is 0 dB throughout the frequency range of concern. The output of residual filter 503, on line 505, is the output of the random number generator 504 filtered in the time domain by residual filter 503.

Since the magnitude spectrum of the random noise is chosen to be flat, when such noise is passed through residual filter 503, the magnitude spectrum of the output will approximate the magnitude spectrum of the residual. The output of the residual filter 503 will be uncorrelated with the residual e by virtue of using the random number generator 504 as input to residual filter 503.

The output of residual filter 503 on line 505 can be used directly as an input to scale by β circuit 607 in FIG. 6. Alternatively, the output of residual filter 505 can be passed through DFT circuit 501; then, as in FIG. 4, the frequency domain result on line 506 is passed to inverse filter 403, IDFT circuit 405, windowing and overlapping circuit 406, and scale by β circuit 407.

FIG. 7 shows a fourth embodiment which is related to that presented in FIG. 5. In FIG. 7, however, the roles of the residual signal and random number generator are, in effect, reversed as compared to FIG. 5. In FIG. 7, the residual signal e is provided as a data input to scrambling filter 703, whose weights are updated periodically through a control input from FIR filter coefficient determination circuit 702, whose function is to select successive time records of the output of random number generator circuit 704. The length of the time records selected by circuit 702 and the amplitude of the random number generator 704 are the same as those described for circuits 502 and 504 of FIG. 5. The output of scrambling filter 703 is the residual signal e filtered in the time domain by scrambling filter 703.

The output of the scrambling filter 703 will be uncorrelated in phase but have substantially the same magnitude (power) spectrum as the residual signal e.

The output of the scrambling filter on line 705 can be used directly as an input to the scale by β circuit 607 of FIG. 6. Alternatively, the output of the scrambling filter can be passed through DFT circuit 701, and as in FIG. 4, the frequency domain result on line 706 is passed directly to inverse filter 403, IDFT circuit 405, window and overlapping circuit 406, and scale by β circuit 407.

Other techniques for decorrelating the phase spectrum of the residual yet maintaining the amplitude spectrum thereof, when generating the probe, could be derived by those of ordinary skill in the art. Such techniques are considered within the scope of coverage of the appended claims.

For the feedforward case of FIG. 3, it is known (see Eriksson) to allow for the possibility of a feedback transfer function between the output of the actuator 16 and the response of the reference sensor 13. This transfer function is not shown in FIGS. 2 or 3 to preserve clarity. The probe generation procedures disclosed herein can be easily extended to and apply equally well to those systems where such a feedback transfer function is significant.

An algorithm for generating an "optimal" probe signal for the purpose of on-line plant identification within the context of feedforward and feedback algorithms applied to systems with time-varying plants has been disclosed. This algorithm differs from the more traditional techniques in that it is implemented as a closed-loop feedback path, and the spectral shape and overall gain of the probe signal are derived from measurements of the residual error sensor. The resulting probe signal maximizes the strength of the probe signal as a function of frequency, providing uniform SNR of the probe relative to the residual for estimating the plant transfer function. This SNR level is related to acceptable noise amplification through a simple expression.

As a consequence of increasing the SNR for plant estimation relative to that achieved by using "white" noise probe signals for "non-white" residuals and plants, this new probe generation algorithm offers the possibility for more uniform broadband reduction and better system performance in the presence of slewing tonals in the disturbance.

What is claimed is:

1. A method of generating a probe signal for use in estimating the transfer function of a time-varying plant in an active noise or vibration control system, comprising steps of:

(a) creating a residual signal by algebraically combining a response due to a disturbance with a response induced by the output of a controller of said control system;

(b) feeding the residual signal back into the controller; and (c) generating said probe signal inside of said controller by processing the residual signal fed back to the controller at said step (b), said processing including spectral shaping so that a substantially constant signal-to-noise ratio probe signal is generated throughout the controller bandwidth.

2. The method of claim 1, wherein said step (c) comprises sub-steps of:

(c1) taking a Discrete Fourier Transform of the residual signal to form a complex spectrum consisting of a magnitude spectrum and a phase spectrum;

(c2) randomizing the phase spectrum of the result of sub-step (c1), while preserving the magnitude spectrum thereof;

(c3) shaping the complex spectrum of the result of sub-step (c2) by dividing said complex spectrum by an estimate of a transfer function from the probe signal to a residual sensor;

(c4) taking the inverse Discrete Fourier Transform of the result of sub-step (c3); and (c5) scaling the result of sub-step (c4) by a gain factor.

3. The method of claim 1, wherein said probe signal generated at said step (c) and the residual signal are input to a least mean square circuit whose output adapts coefficients of an adaptive filter to approximate a transfer function between the probe signal and the residual signal.

4. The method of claim 3, wherein the adaptive filter is used within a filtered-x control algorithm to update coefficients of a control filter.

5. The method of claim 4, wherein an output of said control filter is algebraically combined with said probe signal to create said output of said controller which is used in said step (a) to affect the residual signal.

6. The method of claim 1, wherein the processing which takes place at said step (c) includes making the resulting probe signal uncorrelated with the input residual signal.

7. The method of claim 2, wherein an intermediate sub-step of windowing and overlapping the result of sub-step (c4) occurs between sub-steps (c4) and (c5).

8. The method of claim 2, wherein sub-steps (c1) and (c4) involve instantaneous Discrete Fourier Transforms.

9. A method of generating a probe signal for use in estimating the transfer function of a time-varying plant in an active noise or vibration control system, comprising steps of:

(a) creating a residual signal by algebraically combining a response due to a disturbance with a response induced by the output of a controller of said control (b) determining a magnitude spectrum of said residual signal; and (c) generating a probe signal having a certain magnitude spectrum based on said determined magnitude spectrum of said residual signal, including spectral shaping so that a substantially constant signal-to-noise ratio probe signal is generated throughout the controller bandwidth.

10. The method of claim 9, wherein said step (c) involves inputting random noise through a filter.

11. The method of claim 10, wherein, characteristics of said filter are adaptable based on the magnitude spectrum of said residual signal.

12. The method of claim 9, wherein characteristics of said magnitude spectrum of said residual signal are determined using instantaneous Discrete Fourier Transform operations involving sequential time records.

13. The method of claim 12, wherein the magnitude spectrum of said probe signal is determined for a particular time record from the magnitude spectrum of the residual signal during a previous time record.

14. The method of claim 9, wherein said probe signal generated at said step (c) and the residual signal are input to a least mean square circuit whose output adapts coefficients of an adaptive filter to approximate a transfer function between the probe signal and the residual signal.

15. The method of claim 14, wherein the adaptive filter is used within a filtered-x control algorithm to update coefficients of a control filter.

16. The method of claim 15, wherein an output of said control filter is algebraically combined with said probe signal to create said output of said controller which is used in said step (a) to affect the residual signal.

17. The method of claim 9, wherein said step (c) includes making the resulting probe signal uncorrelated with the input residual signal.

18. The method of claim 9, wherein an instantaneous Fourier transform operation occurs during the generation of said probe signal at step (c).

19. The method of claim 18, wherein the results of said inverse Fourier transform operation are windowed and overlapped during generation of said probe signal at said step (c).

20. The method of claim 19, wherein the results of windowing and overlapping are scaled by a factor related to a prescribed noise amplification limit throughout the controller bandwidth.

21. A method of generating a probe signal for use in estimating the transfer function of a time-varying plant in an active noise or vibration control system, comprising steps of:

(a) creating a residual signal by algebraically combining a response due to a disturbance signal with a response induced by an output of a controller of said control system;

(b) determining a phase spectrum of said residual signal; and (c) generating a probe signal by randomizing the phase spectrum determined at said step (b), including spectral shaping so that a substantially constant signal-to-noise ratio probe signal is generated throughout the controller bandwidth.

22. The method of claim 1, wherein said probe signal generated at said step (c) and the residual signal are input to a least mean square circuit whose output adapts coefficients of an adaptive filter to approximate a transfer function between the probe signal and the residual signal.

23. The method of claim 22, wherein the adaptive filter is used within a filtered-x control algorithm to update the coefficients of a control filter.

24. The method of claim 23, wherein an output of said control filter is algebraically combined with said probe signal to create said output of said controller which is used in said step (a) to affect the residual signal.

25. The method of claim 21, wherein the generation of said probe signal at said step (c) includes making the resulting probe signal uncorrelated with the input residual signal.

26. The method of claim 21, wherein an instantaneous Discrete Fourier transform operation occurs during the generation of said probe signal at step (c).

27. The method of claim 26, wherein the results of said inverse Fourier transform operation are windowed and overlapped during generation of said probe signal at said step (c).

28. The method of claim 27, wherein the results of windowing and overlapping are scaled by a factor related to a prescribed noise amplification-limit throughout the controller bandwidth.

29. A controller in an active noise or vibration control system, said controller comprising:

a control filter receiving an input from a disturbance signal sensed by a reference sensor of said active noise and vibration control system;

a first algebraic addition circuit receiving one input from an output of said control filter and another input from a probe signal;

a probe signal generation circuit receiving an input residual signal sensed by a residual sensor of said active noise and vibration control system and outputting said probe signal;

a plant estimate filter connected at a data input thereof to said probe signal, at a control input thereof to a first least mean square circuit and at a data output thereof to a second algebraic addition circuit; and a third algebraic addition circuit receiving inputs from said residual signal and an output of said plant estimate filter and supplying an output to a second least mean square circuit;

wherein said second addition circuit receives an input from said residual signal;

wherein said first least mean square circuit receives inputs from said probe signal and an output of said second addition circuit;

wherein said second least mean square circuit receives an input from a copy of said plant estimate filter and provides an output to a control input of said control filter; and wherein an output of said first algebraic addition circuit is connected through an output line of said controller to an actuator of said active noise and vibration control system.

30. An apparatus which generates a probe signal for use in estimating the transfer function of a time-varying plant in an active noise or vibration control system, the apparatus comprising:

(a) means for creating a residual signal by algebraically combining a response due to a disturbance with a response induced by an output of a controller of said control system;

(b) means for feeding the residual signal back into the controller; and (c) means for generating said probe signal inside of said controller by processing the residual signal fed back to the controller at said step (b), said processing including spectral shaping so that a substantially constant signal-to-noise ration probe signal is generated throughout the controller bandwidth.

31. The apparatus of claim 30, wherein said means for generating comprises:

(c1) means for taking a Discrete Fourier Transform of the residual signal to form a complex spectrum consisting of a magnitude spectrum and a phase spectrum;

(c2) means for randomizing the phase spectrum of the result of element (c1), while preserving the magnitude spectrum thereof;

(c3) means for shaping the complex spectrum of the result of element (c2) by dividing said spectrum by an estimate of a transfer function from the probe signal to a residual sensor;

(c4) means for taking the inverse Discrete Fourier Transform of the result of element (c3); and (c5) means for scaling the result of element (c4) by a gain factor.

32. The apparatus of claim 30, in which the controller is of a feedforward type.

33. The apparatus of claim 30, in which the controller is of a feedback type.

34. The apparatus of claim 30, in which said means for generating operates in the time domain.

35. The apparatus of claim 30, in which said means for generating operates in the frequency domain.

36. The method of claim 1 wherein the generated probe signal, the residual signal and the output of the controller are processed to provide an estimate of a transfer function between the probe and residual signals.

37. The method of claim 3, wherein said plant transfer function estimation filter is used within a filtered-x algorithm to update the coefficients of a control filter.

38. The method of claim 37, wherein an output of said control filter is algebraically combined with said probe signal to create said output of said controller which is used in step (a).

39. The method of claim 2, wherein the processing of sub-step (c2) includes filtering the results of sub-step (c1) by an estimate of the inverse of a transfer function from the probe signal to the residual signal.

40. The method of claim 3, wherein the processing of step (c) includes filtering a Fourier transformed residual signal by an estimate of the inverse of a transfer function from the probe signal to the residual signal, wherein said estimate is obtained by taking the Discrete Fourier Transform of weights of said adaptive filter, and inverting the transformed weights frequency by frequency.

41. In a system for reducing oscillatory vibration in a selected spatial region in the presence of incident vibratory energy by generating cancelling vibratory energy with an output transducer; a method of generating the cancelling energy which comprises:

(a) sensing residual vibration in said region using a residual sensor and generating a corresponding feedback signal;

(b) filtering a signal derived from said feedback signal using a first set of adjustable parameters which represent the inverse of a transfer function between said output transducer and said residual sensor;

(c) further filtering the result of step (b) using a second set of adjustable parameters;

(d) for determining an estimate of said transfer function, generating a probe signal which has a frequency spectrum which is derived from said feedback signal but which is decorrelated in phase therewith;

(e) coherently detecting the contribution of said probe signal in said feedback signal thereby to measure said transfer function;

(f) adjusting said first set of parameters in accordance with the transfer function thereby measured;

(g) independently adjusting said second set of parameters as a function of said feedback signal and said probe signal thereby to continuously update said estimate of said transfer function;

(h) sensing said incident energy upstream of said region thereby to generate a reference signal;

(i) filtering said reference signal by said transfer function estimate from step (d);

(j) further filtering said reference signal using a third set of adjustable parameters; and (k) adding the result of step (j) to said probe signal to create an actuation signal to said output transducer thereby progressively reducing the residual vibration in said region.

42. A method as set forth in claim 41 wherein said second set of parameters is adjusted in accordance with a least mean square algorithm.

43. A method as set forth in claim 41 wherein said third set of parameters is adjusted in accordance with a least mean square algorithm.

44. In a system for reducing oscillatory vibration in a selected spatial region in the presence of incident vibratory energy by generating canceling vibratory energy with an output transducer; a method of generating the canceling energy which comprises:

sensing residual vibration in said region and generating a corresponding feedback signal;

filtering said feedback signal using a first set of adjustable parameters which represent the complement of the transfer function between said output transducer and said feedback signal;

further filtering said feedback signal using a second set of adjustable parameters;

for determining said transfer function, generating a probe signal which has a frequency spectrum which matches said feedback signal but which is de-correlated in phase therewith;

coherently detecting the contribution of said probe signal in said feedback signal thereby to measure said transfer function;

adjusting said first set of parameters in accordance with the transfer function thereby measured; and independently adjusting said second set of parameters as a function of said feedback signal thereby to progressively reduce the residual vibration in said region.

45. A method as set forth in claim 44 wherein said second set of parameters is adjusted in accordance with a least mean squares algorithm.

46. A method as set forth in claim 44 further comprising means for sensing said incident energy upstream of said region thereby to generate a reference signal which is filtered with said feedback signal.

* * * * *